US010337207B1

(12) United States Patent
Tobias et al.

(10) Patent No.: US 10,337,207 B1
(45) Date of Patent: Jul. 2, 2019

(54) HIGH SECURITY LOCK WITH MULTIPLE OPERATIONAL MODES

(71) Applicants: Marc W. Tobias, Sioux Falls, SD (US); Tobias Bluzmanis, Miramar, FL (US)

(72) Inventors: Marc W. Tobias, Sioux Falls, SD (US); Tobias Bluzmanis, Miramar, FL (US)

( * ) Notice: Subject to any disclaimer, the term of this patent is extended or adjusted under 35 U.S.C. 154(b) by 456 days.

(21) Appl. No.: 14/933,029

(22) Filed: Nov. 5, 2015

Related U.S. Application Data

(60) Provisional application No. 62/100,213, filed on Jan. 6, 2015, provisional application No. 62/078,108, filed on Nov. 11, 2014.

(51) Int. Cl.
*E05C 1/00* (2006.01)
*E05B 27/00* (2006.01)
*E05B 47/00* (2006.01)

(52) U.S. Cl.
CPC ..... *E05B 27/0003* (2013.01); *E05B 47/0001* (2013.01); *E05C 1/00* (2013.01)

(58) Field of Classification Search
CPC ..... E05B 27/0003; E05B 47/0001; E05C 1/00
USPC ..... 70/278.1–278.7, 275, 277, 279, 279.1, 70/280, 280.1
See application file for complete search history.

(56) References Cited

U.S. PATENT DOCUMENTS 4,616,491 A * 10/1986 Genest ..... E05B 47/0012 70/276
4,633,687 A * 1/1987 Fane ..... E05B 47/0012 70/276
4,633,688 A * 1/1987 Beudat ..... E05B 47/0012 292/142
4,745,785 A * 5/1988 Uebersax ..... E05B 47/0012 70/279.1
5,979,199 A * 11/1999 Elpern ..... G07C 9/00182 292/201
6,094,952 A * 8/2000 Clark ..... E05B 17/2092 70/278.1

(Continued)

FOREIGN PATENT DOCUMENTS

WO 0216714 2/2002

*Primary Examiner* — Suzanne L Barrett
(74) *Attorney, Agent, or Firm* — Jeffrey A. Proehl; Woods, Fuller, Shultz & Smith, PC

(57) ABSTRACT

A lock system may comprise a lock assembly including a locking element movable between locking and unlocking positions, and a first lock actuating assembly configured to be mechanically operated to actuate the locking element to move between the locking and unlocking positions, with mechanical operation of the first lock actuation assembly occurring through a physical object. The system may also comprise a second lock actuating assembly configured to be electrically operated to actuate the locking element to move between the retracted and extended positions, with electrical operation of the second lock actuating assembly occurring through reception of a wireless signal by the second lock actuating assembly. The lock and lock actuating assemblies may have at least one mode of operation characterized by the lock assembly being actuated only by substantially simultaneous operation of the first lock actuating assembly and operation of the second lock actuating assembly.

22 Claims, 13 Drawing Sheets

(56) References Cited

U.S. PATENT DOCUMENTS

| | | | | |
|---|---|---|---|---|
| 7,818,984 | B2 * | 10/2010 | Hwang | E05B 13/005 292/21 |
| 9,657,500 | B2 * | 5/2017 | Min | E05B 47/00 |
| 2005/0050928 | A1 * | 3/2005 | Frolov | E05B 47/068 70/278.3 |
| 2005/0144994 | A1 * | 7/2005 | Lies | E05B 47/0676 70/278.2 |
| 2005/0172685 | A1 * | 8/2005 | Keightly | E05B 47/0012 70/279.1 |
| 2006/0117819 | A1 * | 6/2006 | Kilbourne | E05B 47/0012 70/257 |
| 2009/0049878 | A1 * | 2/2009 | Amir | E05B 47/0012 70/279.1 |
| 2010/0212381 | A1 * | 8/2010 | Huang | E05B 47/068 70/279.1 |
| 2012/0055213 | A1 * | 3/2012 | Sorensen | E05B 47/068 70/279.1 |
| 2013/0192316 | A1 * | 8/2013 | McKibben | E05B 47/0001 70/278.1 |
| 2013/0192318 | A1 * | 8/2013 | Yanar | E05B 47/0012 70/279.1 |
| 2014/0250956 | A1 * | 9/2014 | Chong | G07C 9/00174 70/278.1 |
| 2016/0376812 | A1 * | 12/2016 | Yanar | E05B 1/0007 70/278.3 |

* cited by examiner

Fig.1
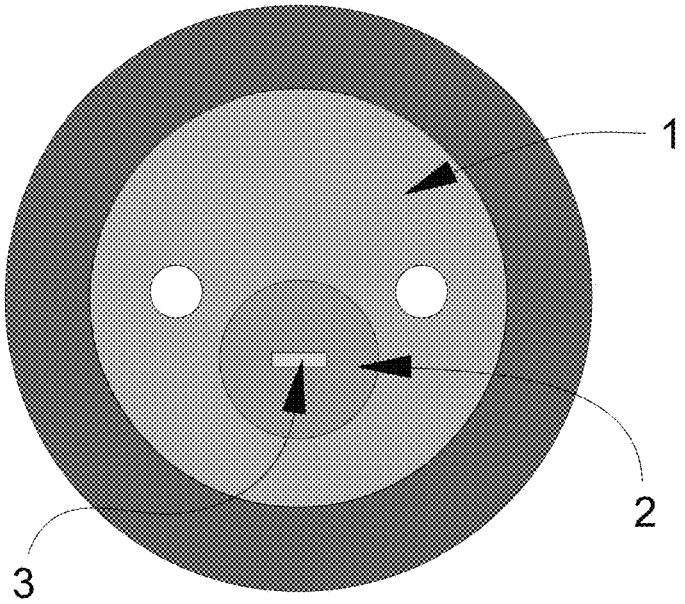
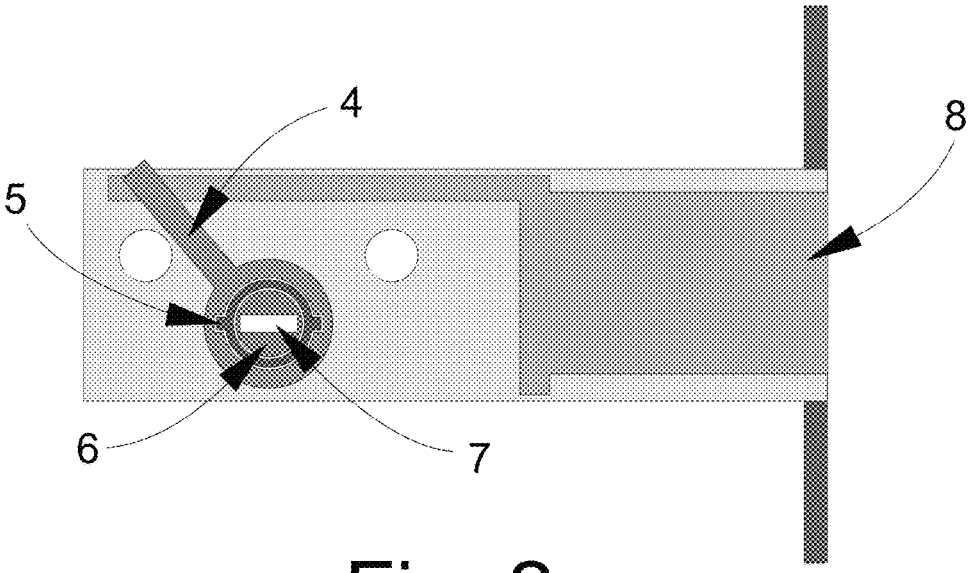
Fig. 2

HIGH SECURITY LOCK WITH MULTIPLE OPERATIONAL MODES

REFERENCE TO RELATED APPLICATIONS

This application claims the benefit of U.S. Provisional patent application No. 62/078,108, filed Nov. 11, 2014; and U.S. Provisional patent application No. 62/100,211, filed Jan. 6, 2015; each of which is hereby incorporated by reference in its entirety,

BACKGROUND

Field

The present disclosure relates to high security locks and more particularly pertains to a new high security lock with multiple operational modes for providing an enhanced level of security in a hybrid lock.

Description of the Prior Art

There are three primary categories of locks in current use, including mechanical cylinders, electro-mechanical locks, and electronic locks. Electronic locks may utilize credentials transmitted to the lock through a variety of different wireless technologies, including radio-frequency identification, (RFID), near field communication (NFC), Low Energy Bluetooth, or through a keypad used to enter a code number, commonly known as a personal identification number (PIN). Electronic locks may also have a mechanical lock to bypass the electronic lock in the event of electronic failure.

There are two main classifications that define the security of a lock: conventional and high security. Standards organizations such as Underwriters Laboratories and the Builders Hardware Manufacturers Association (BHMA) rate the level of security provided by a lock based upon three criteria. The first is the lock's resistance to physical attack (forced entry), the second is the lock's resistance to non-destructive manipulation (covert or surreptitious entry), and the third is the lock's ability to restrict the availability of key blanks and to make their replication difficult (key control). Key control is particularly critical for high security locks, but is also important for some conventional locks. The concept and practice encompasses both organizational and physical key security. Key control relates to the designed characteristics of the keyway, internal active locking components, and the design of the mechanical bitted key to make it difficult to obtain blank keys, and to control the ability to make unauthorized keys through duplication, replication and simulation.

High security locks must be designed to make the availability of restricted keys and corresponding keyways very difficult to obtain by unauthorized individuals. Patented key protection often incorporates special security enhancements such as undercuts, movable interactive elements, special shapes, unique bitting shapes and sizes, angled cuts, dimple cuts, and countless other innovations to make mechanical keys more secure. Some manufacturers have also introduced magnets and electronic elements to frustrate key copying without the proper authority.

The fundamental problem with virtually all mechanical and electro-mechanical lock designs is that they can be compromised, with varying degrees of difficulty, by various methods of covert, forced attack and the compromise of even the highest levels of key control, alone or in combination with each other.

The most secure locks, even if they contain or are based upon electronic credentials, may ultimately fail. They are largely ineffective against skilled craftsmen or criminals who understand the recognized methods of compromise of mechanical locks. Not only are the locking cylinders at risk, but virtually all conventional and high security keys can be copied, simulated, or replicated, because the easiest way to open a lock is withy a key.

Pin tumbler and other forms of traditional mechanical locks and keys suffer from significant security vulnerabilities including picking, impressioning, decoding, key duplication by conventional means and the newer three dimensional (3D) printing technologies, and the extrapolation and decoding of the top level master key within a system of locks. Such mechanically-based cylinders are all designed upon well-known and old technologies that make them subject to compromise by skilled individuals in the art of covert and forced entry. Most mechanical cylinders do not have a high security rating, which means their security can be very easily circumvented through traditional methods of attack. The security of mechanical cylinders and their keys are further at risk due to the constantly developing 3D printing technology which can allow the compromise of the highest security systems if such systems are based solely upon the security of mechanical keys.

By definition, mechanical cylinders intended for high security installations are themselves secure against physical attacks such as drilling, application of torque, and other forms of compromise. In addition, lock manufacturers have incorporated many different designs to make the internal active locking components highly resistant to covert forms of manipulation, such as picking and impressioning and decoding and bumping. While the active locking components, such as pin tumblers, sliders, disks, sidebars and other security enhancements that are contained within these high security-rated cylinders are secure and meet stringent standards promulgated by Underwriters Laboratories, BHMA, and European standards organizations for protection against cover entry attacks, their mechanically-based credentials (keys) are not of equivalent security.

The critical vulnerability for high security mechanical cylinders is their metal keys. These "credentials" can be copied by many traditional means known to those skilled in the art, including casting, molding, plastics, portable milling machines such as the German Easy Entrie, and epoxy. Keys can also be visually decoded, photographed and reproduced, and often easily simulated in different materials, including plastics.

The latest threat to all mechanically-based locking systems is 3D printer technology. The current generation of 3D printers allows the reproduction of virtually any mechanical key, thus potentially placing at risk the security of every mechanically-based locking system and its keys, even those of the highest security as defined by the standards organizations. 3D printers have been able to reproduce blank keys and those with bitting, for many different systems that are ostensibly restricted and highly resistant to copying or simulation. Bump keys have been created from photographs and then generated in plastic or metal with 3D printers, and master keys systems can be easily compromised once blank keys are produced through this technology.

Several lock manufacturers produce a hybrid lock that contains both a mechanical locking portion, and an electronic-controlled element. Both of these security layers (mechanical and electronic) must operate in parallel, so the ostensible security of the lock is enhanced. Electronic credentials for these locks are embedded in the keys, so that both traditional mechanical bitting and an electronic element is required to open the lock. The idea in creating electro-mechanical locks was that they would have the best of both worlds as far as their security. That is, there would be two distinct security layers running in parallel. The mechanical bitting provided the first level of protection against physical and manipulation attacks, and the electronic credentials offered a much higher level of security for key control that does any mechanical key.

The problem with this premise is that all electro-mechanical cylinders are a compromise because of space limitations. All of the components must be compressed into the same form-factor as their traditional mechanical-only counterpart. The result is that while the electronic credentials are much more secure than their mechanical key counterpart, the physical security of the electro-mechanical cylinder will never meet the same high security criteria as conventional mechanical high security cylinders. There are inherent compromises in physical security because of the space limitation and requirement for the use of less secure materials.

The mechanical bitting portion of these electro-mechanical cylinders is still subject to covert entry attack. It has been demonstrated repeatedly that electro-mechanical cylinders can be compromised by both forced and covert entry because of inherent design compromises, as well as certain attacks on the mechanical elements that are controlled by electronic credentials.

All-electronic locks, meaning those that rely solely upon electronic credentials for their security, suffer much the same security deficiency as electro-mechanical cylinders. They are not physically secure against forced attack, even though their electronic credentials offer many options not available in mechanical designs.

SUMMARY

In one aspect, the present disclosure relates to a lock system which may comprise a lock assembly including a locking element movable between a locking position and an unlocking position. The system may also comprise a first lock actuating assembly configured to be mechanically operated to actuate the locking element of the lock assembly to move between the locking and unlocking positions, and a second lock actuating assembly configured to be electrically operated to actuate the locking element of the lock assembly to move between the locking and unlocking positions. The lock assembly and the first and second lock actuating assemblies may have a first mode of operation characterized by the first lock actuating assembly being capable of actuating the lock assembly, a second mode of operation characterized by the second lock actuating assembly being capable of actuating the locking element of the lock assembly, and a third mode of operation being characterized by the lock assembly being actuated only by substantially simultaneous operation of the first lock actuating assembly and operation of the second lock actuating assembly.

In another aspect, the disclosure relates to a lock system that may comprise a lock assembly including a locking element movable between a locking position and an unlocking position, and a first lock actuating assembly configured to be mechanically operated to actuate the locking element of the lock assembly to move between the locking and unlocking positions, with mechanical operation of the first lock actuation assembly occurring through a physical object. The system may also comprise a second lock actuating assembly configured to be electrically operated to actuate the locking element of the lock assembly to move between the locking and unlocking positions, with electrical operation of the second lock actuating assembly occurring through reception of a wireless signal by the second lock actuating assembly. The lock assembly and the first and second lock actuating assemblies may have a first mode of operation characterized by the first lock actuating assembly being capable of actuating the lock assembly and the second lock actuating assembly being incapable of actuating the lock assembly, a second mode of operation characterized by the second lock actuating assembly being capable of actuating the locking element of the lock assembly and the first lock actuating assembly being incapable of actuating the lock assembly, and a third mode of operation being characterized by the lock assembly being actuated only by substantially simultaneous operation of the first lock actuating assembly and operation of the second lock actuating assembly.

In yet another aspect, the disclosure may relate to a lock system that may comprise a lock assembly including a locking element movable between a locking position and an unlocking position, and a first lock actuating assembly configured to be mechanically operated to actuate the locking element of the lock assembly to move between the locking and unlocking positions, with mechanical operation of the first lock actuation assembly occurring through a physical object. The system may also comprise a second lock actuating assembly configured to be electrically operated to actuate the locking element of the lock assembly to move between the locking and unlocking positions, with electrical operation of the second lock actuating assembly occurring through reception of a wireless signal by the second lock actuating assembly. The lock assembly and the first and second lock actuating assemblies may have at least one mode of operation characterized by the lock assembly being actuated only by substantially simultaneous operation of the first lock actuating assembly and operation of the second lock actuating assembly.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, and the particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein:

FIG. 1 is a schematic rear view of basic lock components, including a lock shell, lock plug and plug tailpiece, which may be utilized with the new lock system according to the present disclosure.

FIG. 2 is a schematic side view of basic lock components, including a bolt and bolt actuator lever, which may be utilized with the new lock system according to the present disclosure.

DETAILED DESCRIPTION

Figure 3:
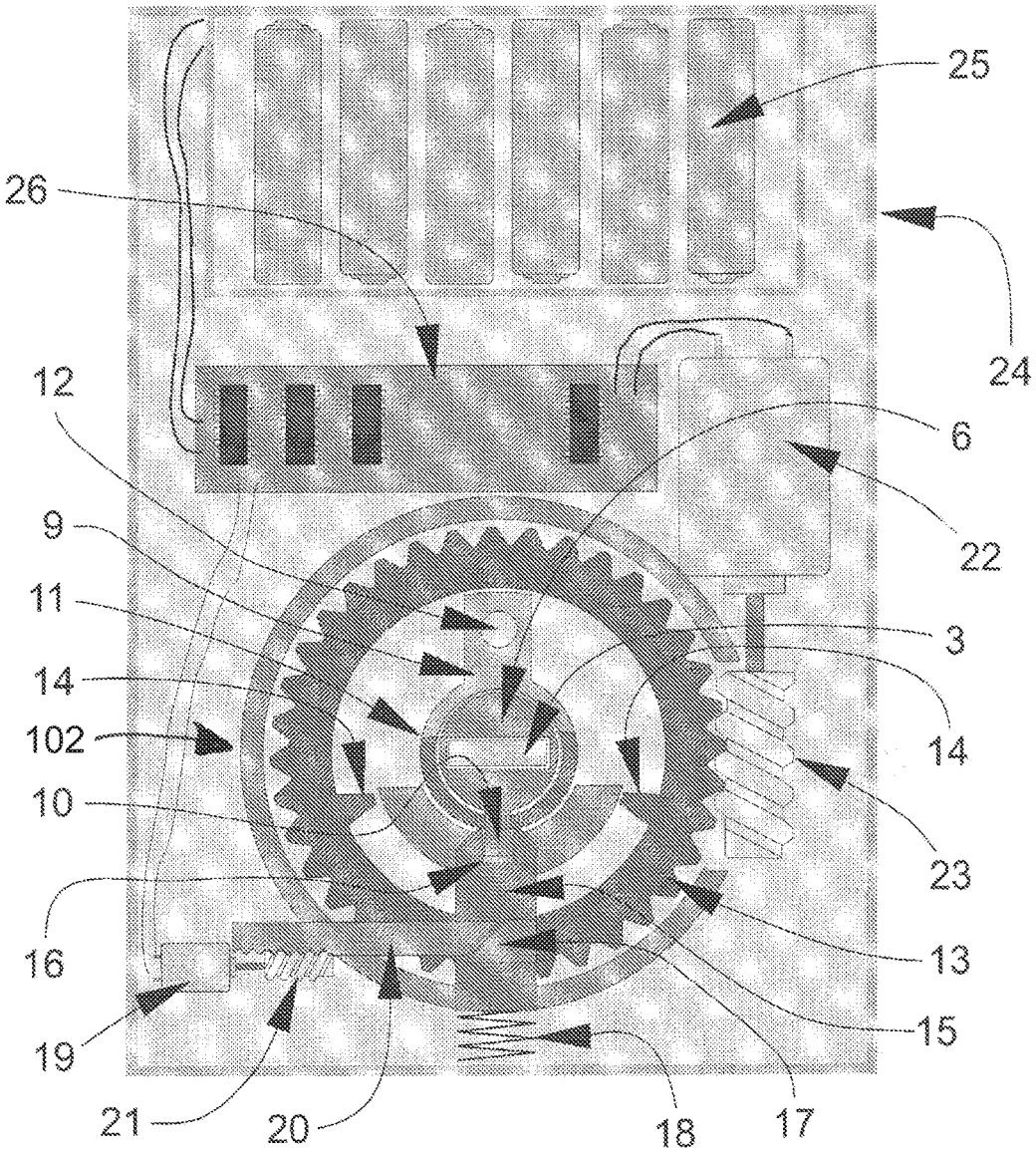
FIG. 3 is a schematic front view of elements of an embodiment of the lock system, according to an illustrative embodiment.
Figure 4:
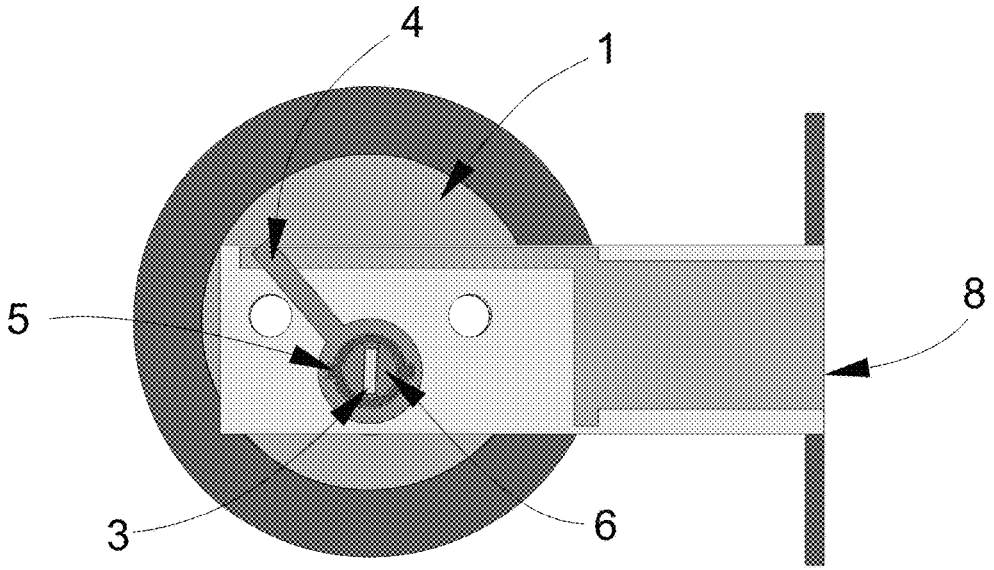
FIG. 4 is a schematic side view of the lock elements with the bolt in the retracted position, according to an illustrative embodiment.

With reference now to the drawings, and in particular to FIGS. 1 through 23 thereof, a new high security lock with multiple operational modes embodying the principles and concepts of the disclosed subject matter will be described.

The applicants have recognized the need for a lock that is physically secure against both forced and covert attacks and incorporates two separate yet integrated security layers: mechanical and electronic. Applicants have recognized that both mechanically- and electronically-triggered or operated lock systems have at least some degree of vulnerability to covert attacks. Mechanically-operated locks can be compromised in a number of ways, several of which are mentioned in this disclosure. Electronically-operated locks may be triggered by wireless transmissions or retransmissions or field generations that may or may not originate from authorized devices or objects, such as key cards, security fobs, etc. While there may seem to be some similarity to current electro-mechanical cylinder designs, there is a critical distinction, as the disclosed lock system provides security against brute force physical attacks, manipulation attacks, and the protection of key control, and can be added to virtually any mechanical-based cylinder. In order to be secure, a lock must contain a locking mechanism based upon mechanical components that has been proven to be secure against picking, impressioning, decoding, key copying and key simulation, a physically-secure plug and shell to meet UL and BHMA standards, and must also contain advanced electronic credentials to allow different options that are required to protect against present security threats. The modes of locking and the ability to alter the use of mechanical and electronic elements provide a secure locking system as described herein. Significantly, while known lock systems provide only a single mode of operation (e.g., only a mechanical mode of operation, or only an electronic mode of operation, or only a combination mechanical and electronic mode of operation), the disclosed lock system provides the user with the option to use any one of multiple modes on the same lock, including, for example, mechanical operation, electronic operation, or a combination of mechanical and electronic operation. As an added level of security, some embodiments may also provide the option to disengage the deactivated portion of the device (e.g., mechanical or electrical) from influencing the operation of the latch or bolt. As another added security measure, the operational mode of the lock system may not be made apparent from viewing the installed system so that attempts to compromise the lock must deal with the need to determine the current operational mode of the lock system.

The disclosure describes an electronic and mechanical cylinder and configuration of components, either internal to any deadbolt cylinder configuration, or as an external "add-on" module to a deadbolt device, that may incorporate the attributes of the highest security mechanical cylinders, together with the enhanced electronic credentials that are found in the highest security electronic cylinders. The locking system of the disclosure may operate with conventional as well as high security cylinders and will provide a high level of security against simple and sophisticated methods of attack and will allow the user three distinct levels of security for a locking system which can be locally or remotely programmed, depending on hardware configuration and required levels of security of the user or facility. The unique combination of mechanical and electronic credentials and how they are implemented distinguishes this invention from current technology and state of the art.

When set to the highest security level, the combination of the lock system may be virtually impervious to attacks by covert and forced entry, and may also be totally resistant to the compromise of key control that can normally be accomplished through the use of traditional known methods of copying, duplicating, simulating and replicating the warding and bitting portion of mechanical keys. The lock system may also make the use of advanced techniques like 3D printer technology essentially meaningless because even if the correct key is produced for this lock, it will not open it without the correct electronic credentials to be operated in parallel. In other words, in one operating mode, the rotation (or blocking of rotation) of the plug, even with the correctly bitted key, will not result in the lock being able to be opened. The lock system 100 may be distinguished from current electro-mechanical designs, or purely mechanical designs, in this ability to, in one mode, block the plug from turning through the use of the correct key.

The lock system 100 allows for embodiments with several variations and designs to accomplish the same result of securing a mechanical cylinder against different attacks. In some embodiments, the lock system may be an add-on separate component that will operate with a single-sided deadbolt, which is a common device used in many applications throughout the world. Most single-sided deadbolts rely upon a thumb-turn positioned on the inside of the door, which provides the ability to retract and extend the bolt by the user turning the thumb-turn. The add-on embodiment of the lock system 100 differs from those currently in use.

The lock system 100 also differs from known electronic add-on devices presently on the market in a number of critical respects. The typical mode of operation for known electronic control of deadbolt locks require some form of wireless credentials, usually low energy Bluetooth, NFC, or RFID, as well as WiFi, to communicate to the lock through the use of a key fob or smartphone application. When the correct credential is presented, such as in the form or a receipt of a wireless signal recognized to be authorized or authentic, the lock can be opened or locked. In some cases, the face of the cylinder is touched, which senses the presence of the user. When the electronic credentials are detected, the lock can be opened or locked.

When electronic add-on products are added to deadbolt cylinders, the mechanical cylinder and key only provide a backup in case of failure of the electronics, and thus provide the ability to circumvent the electronic credentials. The problem with this arrangement is thus the same as conventional mechanical locks—the locks can still be compromised in a variety of means, depending upon their security rating and design. The locks are subject to forced and covert attacks, and do not provide any meaningful key control, so these electronic add-on systems are in essence convenience locks that can be opened electronically, obviating the need for mechanical keys.

One significant distinction between the lock system of the disclosure and other known locks is that the electronic control mechanism of the system allows the system to operate in one of three states, depending upon security requirements. Thus, the distinctive and unique feature of this invention is the control and mechanical module that determines how the lock functions and to effectively block access to the plug and internal components that would allow manipulation. The present disclosure provides a lock system with three modes of locking and access. Depending upon the setting selected by the user, the lock can be set to a (first) mode of mechanical actuation only, a (second) mode of electronic credentials actuation only, or a (third) mode of electro-mechanical actuation that requires the use of the mechanical actuation and electronic credentials, usually presented in a simultaneous or substantially simultaneous manner. For the purposes of this disclosure, substantially simultaneous actuation of the first and second lock actuating assemblies may include actuations of the first and second lock actuating assemblies that occur within a predetermined time period. For example, the predetermined time period in which actuation of both of the first and second lock actuating assemblies must occur to be considered substantially simultaneous actuations may range up to one minute between the time of actuation of one lock actuating assembly and the time of actuating the other lock actuating assembly, and may include possibly more time between actuations. In some of the more preferred implementations, the time between the actuations of the first and second locking actuating assemblies may be less than approximately 20 seconds, and in some of the most preferred implementations may be less than approximately 10 seconds or even approximately 5 seconds. In the third mode, if actuations of both of the first and second lock actuating assemblies are not detected within the predetermined period representing a substantially simultaneous actuation, then the lock assembly will not be actuated and actuation of the first and second lock actuations assemblies must be repeated if the lock assembly is to be successfully actuated.

The first mode, or mechanical-only mode, may be considered the relatively lowest security operating mode of the lock system and permits the mechanical lock cylinder to operate substantially as normal. For example, the user inserts the properly-bitted key, turns the key, and the lock either locks or unlocks. In this mode, there may be essentially no change to the lock's normal operation.

In the second mode, or electronic credentials-only mode, only the electronic credentials are required and utilized to control the actuation mechanism that allows the bolt to be extended or retracted. The operation of the key and its link to the bolt is removed and thus rendered inoperable. Significantly, in the second mode, even a properly-bitted key would have no effect upon the control of the bolt in contrast to normal operation of a conventional mechanical lock. In this mode, the operation of the mechanical lock may not operate the bolt, latch, or other fixing mechanism that is normally utilized to move the bolt to secure or unsecure a door. The second mode may be considered to provide a relatively higher level of security as compared to the first mode.

The third mode may provide the relatively highest degree of security among the modes as it requires two different types of authentication (e.g., mechanical key AND electronic credentials) to be used to actuate the lock into an unlocked condition, while the first and second modes only require one type of authentication (e.g., mechanical key OR electronic credentials) to unlock the system.

Depending upon the interface configuration, the lock system may either block any rotation of the plug in the second mode and as a result block the ability to manipulate internal lock components by picking and other covert entry attacks, or the plug will rotate free of the actuation mechanism even if a key with the proper bitting is inserted into the plug or the proper bitting is simulated (e.g., through picking), but such rotation will not result in any movement of the bolt or latch. Whether 1) the plug is blocked from rotation or 2) allowed to spin freely may be determined by the character of the interface between the plug tailpiece and the actuation mechanism, and in some embodiments may be set or determined by the user through the various setting provided to the user.

If the interface of the plug tailpiece and actuation mechanism is configured so that the two elements are disconnected or de-linked from each other, then the different modes of attacking or subverting the lock as described herein will not result in the bolt being actuated. While these manners of attacking the lock may result in the plug being turned, as well as the tailpiece, such attacks will have no effect because the plug will spin free of the actuation mechanism. In the second mode, unless the correct electronic credentials are presented, the actuation mechanism and thus the bolt cannot be moved or extended.

If the interface of the plug tailpiece and actuation mechanism is configured so that rotation of the plug, even with insertion of a correctly-bitted key, is physically blocked and cannot occur, then any attempt at subverting the lock by picking, impressioning, decoding, bumping, or even the use of the correct key will not result in the lock being opened, or its security being compromised.

By blocking rotation of the lock plug, which may extend to blocking as little as one degree of rotation, the recognized methods of covert bypass may be frustrated. Picking and impressioning cannot occur without a very slight movement of the plug when tension is applied. Similarly, master key extrapolation and bumping is rendered virtually impossible because rotational movement of the plug is required for feedback as to the success or failure of the process.

In implementations of the third mode, until the proper electronic credentials are presented to the lock simultaneously or substantially simultaneously with the correctly bitted key, the interface of the plug tailpiece and the actuation mechanism may completely block rotation of the plug through the use of a number of different mechanisms, including a motor drive, worm gear, solenoid, or magnetic coupling. In the third mode, key control is enhanced because even having the correctly bitted key will not permit the lock to be opened without the correct credentials.

These three modes of operation allow the user to determine, on a dynamic real-time basis, the desired security level provided by the lock system. Generally, only one mode of operation may be activated at a time. The mode of the lock system may be set in any suitable manner, such as by physical or mechanical controls on the lock system, or even both operated simultaneously, but in many implementations it may be desirable to provide control of the modes electronically and in particular wirelessly. In addition to changing modes, it may be desirable to add, delete, or change the device or devices having the appropriate credentials to operate the lock system, and this may also be performed electronically and/or wirelessly. Switching between the modes may thus be effected using a portable device or computer, or even through a wireless network of the structure on which the lock system is installed. The modes may be toggled or changed manually, or may be changed automatically based upon factors such as, for example, time of day, day of week, etc. In some instances it may be desirable to allow the use of a mechanical key (only) to operate the lock system, such as based upon time of day, but at other times to require a higher level of security. In some locations, it may be desirable or necessary to allow access through the use of electronic credentials only during certain times, particularly since the electronic credentials may be transmitted to an authorized recipient electronically. In other circumstances where the highest degree of security is required, the combination of mechanical and electronic credentials may be required, an option that may also provide additional options for audit of access and control Significantly, a person seeking to subvert the lock system would not know the mode of the system that is active and in effect, and thus could spend a great deal of time attempting to mechanically open the lock using covert means, only to find that being able to turn the lock plug does not result in retraction of the bolt. In any of the modes in which the lock is configured to prevent the plug from turning, no mechanical feedback can be obtained during the picking or impressioning attempts.

In greater detail, the lock system 100 may utilize various elements of conventional locks. As illustratively shown in FIG. 1, the lock system may include a shell 1 with a plug cavity in which a plug 2 may be rotatably located. The plug 2 typically has a key slot (not shown) that is located in the front face of the plug, and a tailpiece 3 may extend from the rear of the plug. As illustratively shown in FIG. 2, a bolt actuator lever 4 may be rotatable or pivotable with respect to a housing of the lock. The lever 4 may extend outwardly from an outer hub 5 which is mounted on an inner hub 6. The inner hub may define a slot 7 configured to receive the plug tailpiece so that rotation of the plug and tailpiece would (in most conventional locks) rotate the inner and outer hubs as well as the lever 4 to cause a locking or latching element, such as the bolt 8, to be moved between an unlocking position—typically a retracted condition (see FIG. 4) and a locking position—typically an extended condition (see FIG. 6).

As illustratively shown in FIG. 3, an actuation mechanism 102 may form a mechanical interface between the plug 2 and the bolt 8, as well as providing an interface for an electromechanical mechanism for actuating the bolt between the retracted and extended positions. As will be appreciated from FIG. 3, the outer 5 and inner 6 hubs as well as the tailpiece may interface with the actuation mechanism. A cam 9 may extend from the outer hub, and a hub tab 10 may also extend from the outer hub, and in some configurations may extend in a direction from the hub that is substantially opposite from the direction which cam 9 extends. Inner hub 6 may be able to rotate with respect to outer hub 5 within limits set by the position of hub contact points 11 on the outer hub. Connection structure 12, illustratively shown as an aperture in the cam 9, may provide a connection point for the manual actuation structure of the lock, typically a thumb-turn knob, that is usually located on the inside surface of the door. A gear 13 may be rotated by electrical elements of the lock system 10 to bring either contact point 14 on the gear into contact with the cam 9 to cause rotation of cam 9 electrically and as a result movement of the bolt 8.

A plug-blocking mechanism may be provided to block rotation of the plug 2 with respect to the shell 1 by acting on the tailpiece 3 of the plug (see FIG. 3). More specifically, a blocking element 15 may be provided to selectively engage the hub tab 10 which extends from the inner hub 6. The blocking element 15 may be movable between at least two positions, including a blocking position shown in FIG. 3, in which a gate or groove 16 formed in blocking element 15 engages the hub tab 10. The blocking element is also movable to an unblocking position, shown for example in FIGS. 5 and 7, which releases the hub tab 10 and allows for rotation of the inner hub 6 with respect to the outer hub 5, as well as rotation of the tailpiece 3. Actuation of the blocking element between the blocking position and the unblocking position may be effected in any suitable manner, but illustratively employs a wedge block 17 mounted on the blocking element to move with the blocking element against a biasing spring 18, which tends to bias the blocking element into the blocking position. An actuating member 20 may be moved into contact with actuating block 17 through the operation of a blocking motor 19 which rotates a worm gear 21 which engages teeth on the actuating member 20. Operation of the blocking motor 19 in one rotational direction pushes actuating member 20 against the wedge block 17 to move the blocking element 15 towards a release position against the biasing spring 18. Rotation of the motor in an opposite rotational direction tends to pull the actuating member 20 away from the wedge block 17 which tends to release the blocking element 15 to move toward the hub tab 10 and engage the hub tab to prevent movement of the tab 10.

As further illustratively shown in FIG. 3, an operating motor 22 may be provided for rotating a worm gear 23 to electrically operate the lock through the rotation of gear 13 in either of two rotational directions. Operation of the operating motor 22, as well as the blocking motor 19, may be controlled by an operational control 26, which may be supplied power from a power source 25 such as replaceable or rechargeable batteries. The control 26 may include processing elements as well as communication elements such as, for example, wireless communication capabilities. The actuation mechanism 102 may be housed inside a housing 24 to provide a self-contained unit. The housing 24 of the actuation mechanism may be mountable on an inside or inner surface of a door, such that the housing at least partially covers a hole formed through the door for the lock system, and so that the tailpiece of the plug is able to be engaged and actuated by the mechanism 102.

Figure 5:
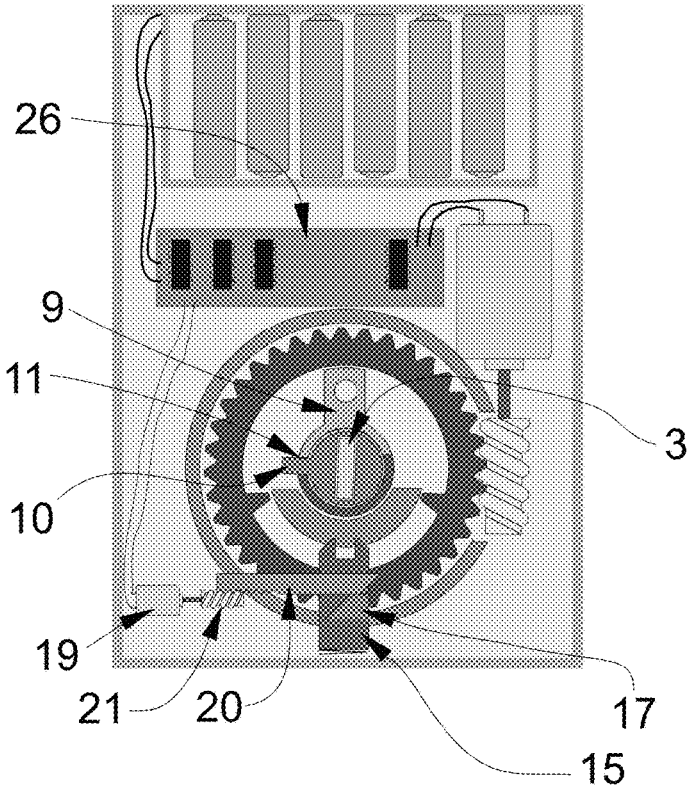
FIG. 5 is a schematic front view of elements of the lock system in which the hub tab on the inner hub has been released by the blocking element and the inner hub has been partially rotated by the tailpiece of the plug to engage a contact point on the outer hub, according to an illustrative embodiment.
Figure 6:
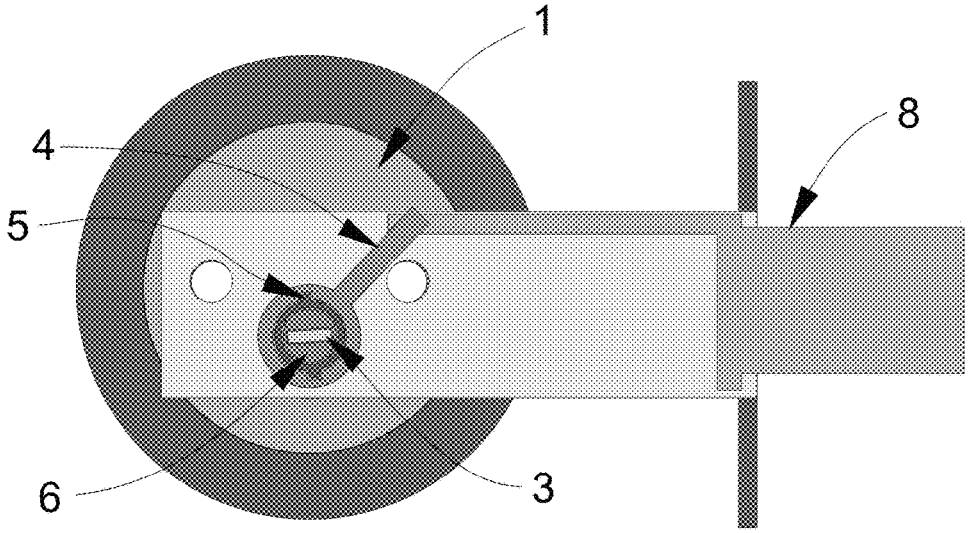
FIG. 6 is a schematic side view of the lock elements with the bolt in the extended position, according to an illustrative embodiment.
Figure 7:
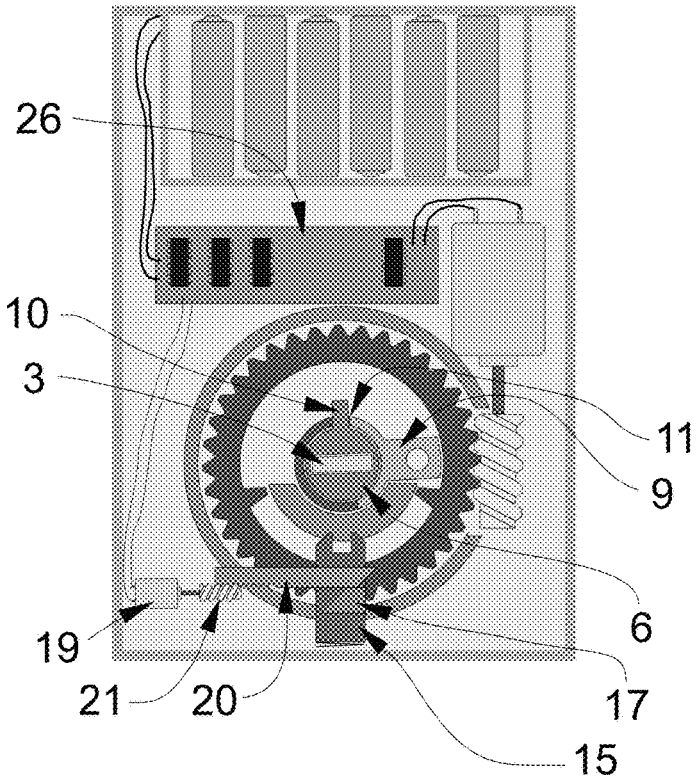
FIG. 7 is a schematic front view of elements of the lock system in which the inner hub and the outer hub have been more fully rotated as compared to FIG. 5, and the movement of the outer hub has resulted in the movement of the bolt into the extended condition shown in FIG. 6, according to an illustrative embodiment.
Figure 8:
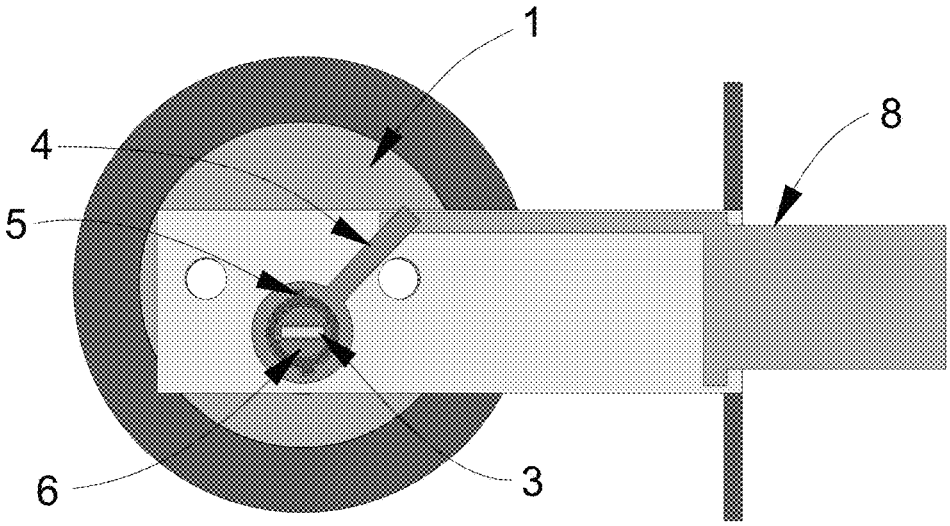
FIG. 8 is a schematic side view of the lock elements with the bolt in the extended position, according to an illustrative embodiment.
Figure 9:
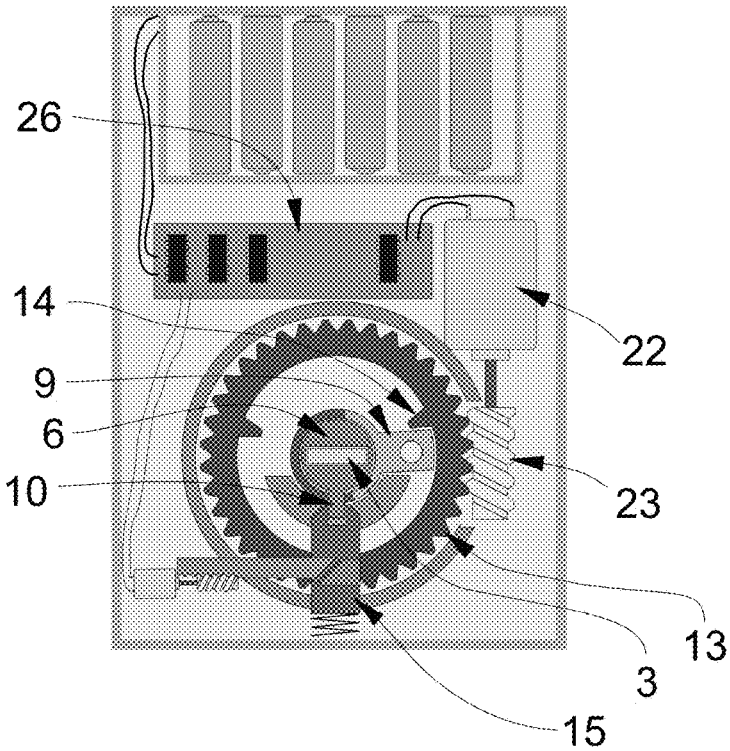
FIG. 9 is a schematic front view of elements of the lock system in which the hub tab on the inner hub is locked by the blocking element, and the outer hub has been fully rotated by the contact point on the gear operated by the operating motor and gear, according to an illustrative embodiment.

As illustratively shown in FIG. 5, the blocking motor 19 may be operated to rotate the blocking worm gear 21 to cause the actuating member 20 to contact and press against the wedge block 17. Contact between the actuating member 20 and the wedge block 17 may cause the blocking element 15 to move out of engagement with the hub tab 10 which permits the inner hub 6 to rotate with respect to outer hub 5, such as when a correctly bitted key is inserted into the plug 2 and turned to thereby turn the plug tailpiece 3 engaged by the inner hub 6. In FIG. 5, the inner hub has been rotated approximately 90 degrees from its locked position, and the hub tab 10 has engaged a contact point on the outer hub 5. Now looking to FIG. 7, continued rotation of the inner hub by the plug and the plug tail piece has caused the outer hub 5 and the cam 9 mounted thereon to rotate approximately 90 degrees from the position shown in FIG. 5. Movement of the cam 9, as well as the connection structure, or hole 12, causes movement of the lever 4 as shown in FIG. 6 which is locked to move as a unit with the outer hub. Also, the thumb knob is rotated through the connection structure 12 on the cam 9. Movement of the lever 4 thus moves the bolt 8 from the retracted to the extended position, such as is shown in FIG. 8

Figure 10:
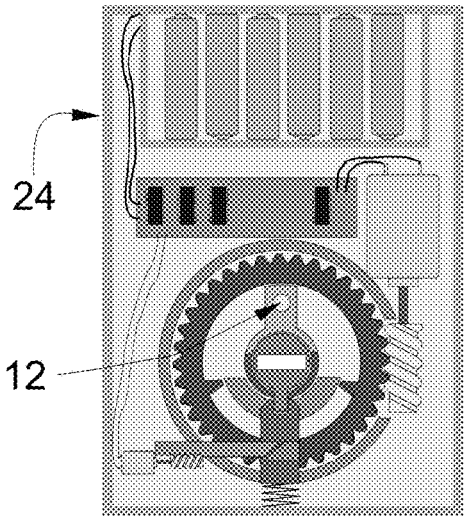
FIG. 10 is a schematic front view of elements of the lock system positioned in a housing, according to an illustrative embodiment.
Figure 11:
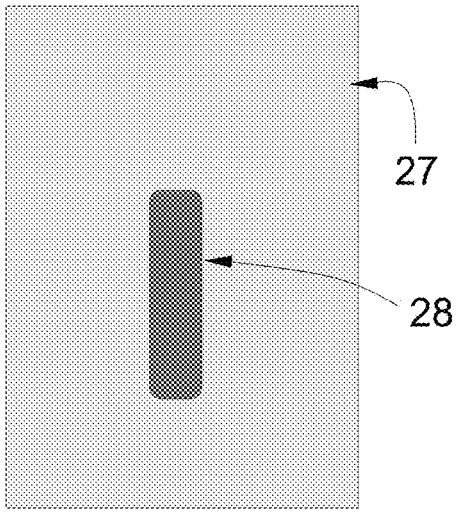
FIG. 11 is a schematic front view of an illustrative cover for the housing of the lock system, according to an illustrative embodiment.
Figure 12:
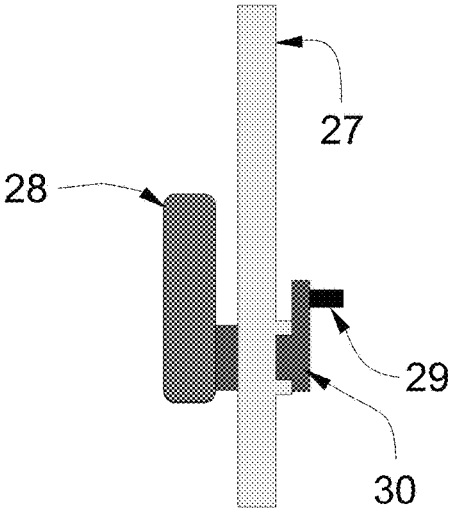
FIG. 12 is a schematic side view of the cover shown in FIG. 11, according to an illustrative embodiment.
Figure 13:
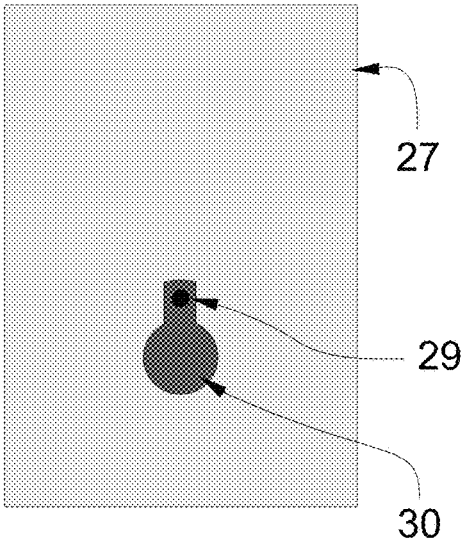
FIG. 13 is a schematic rear view of the cover shown in FIG. 11, according to an illustrative embodiment.

As is illustratively shown in FIG. 11, a cover plate 27 may be provided for positioning over and enclosing the interior of the housing 24 as shown in FIG. 10. A thumb turn knob 28 may be positioned adjacent to an outside surface of the cover 27 for easy manual access by a user. The thumb turn knob 28 may be rotatably mounted on the cover via a pivot shaft 30 which extends through the cover plate as illustratively shown in FIG. 12. An interface pin 29 may be mounted on a lateral extension of the shaft 30 such that rotation of the thumb turn knob 28 rotates not only the shaft 30 but also the pin 29 about a rotational axis of the shaft 30. When the cover 27 is installed on the housing 24, the pin 29 may engage and be inserted into the hole of the connection structure 12 on the cam 9.

Figure 14:
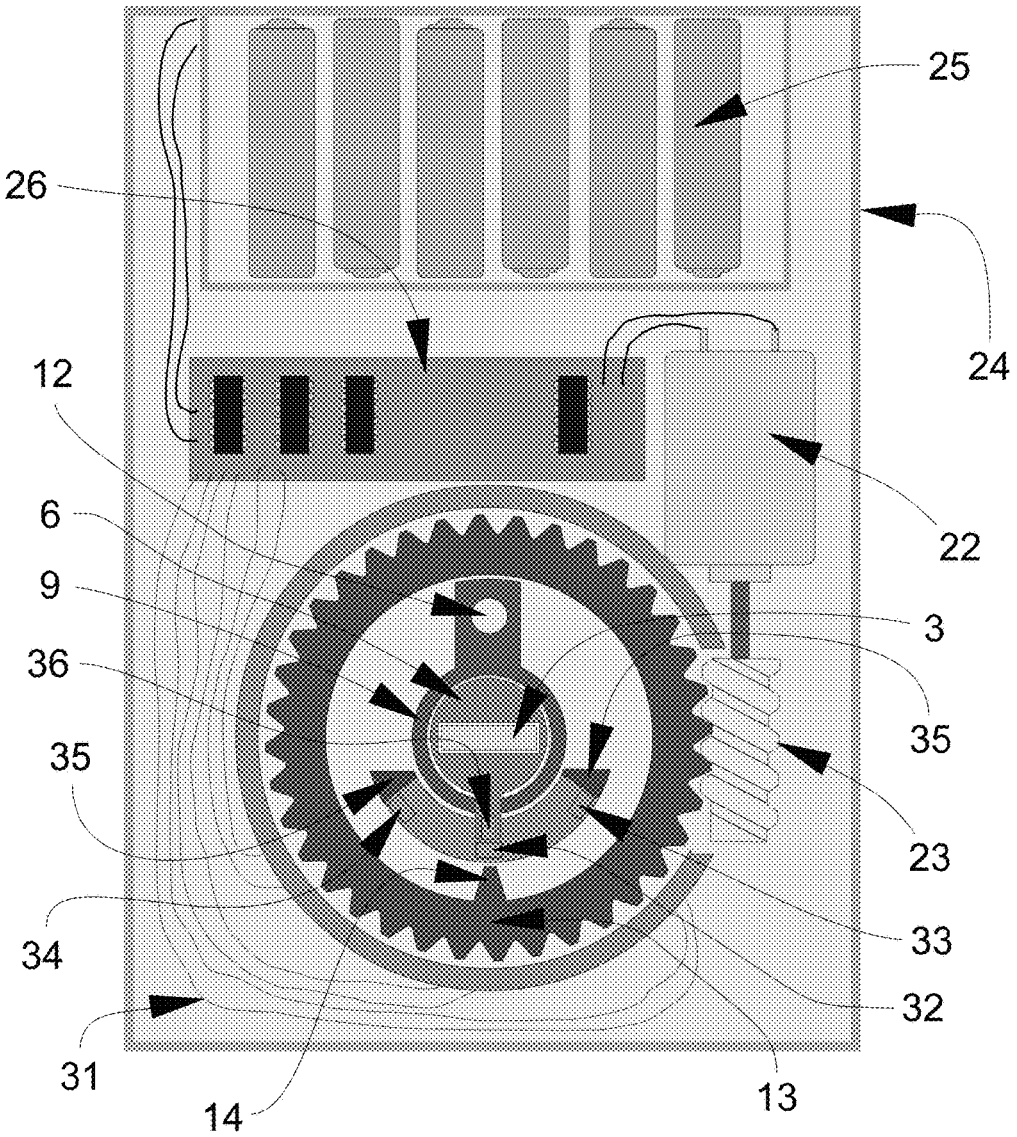
FIG. 14 is a schematic front view of another illustrative embodiment of the lock system.
Figure 15:
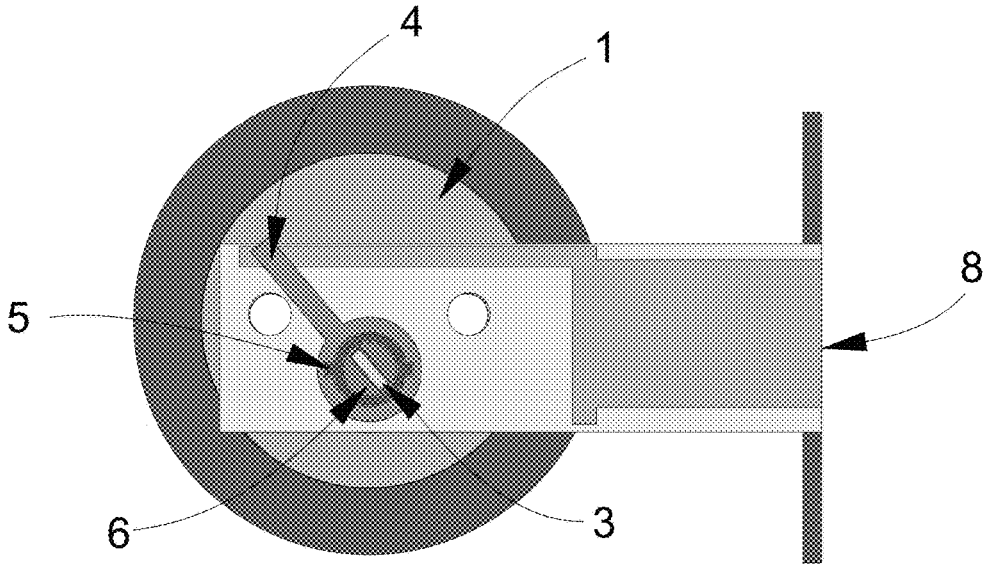
FIG. 15 is a schematic side view of lock elements generally corresponding to the illustrative embodiment of FIG. 14 with the bolt in the retracted position.
Figure 16:
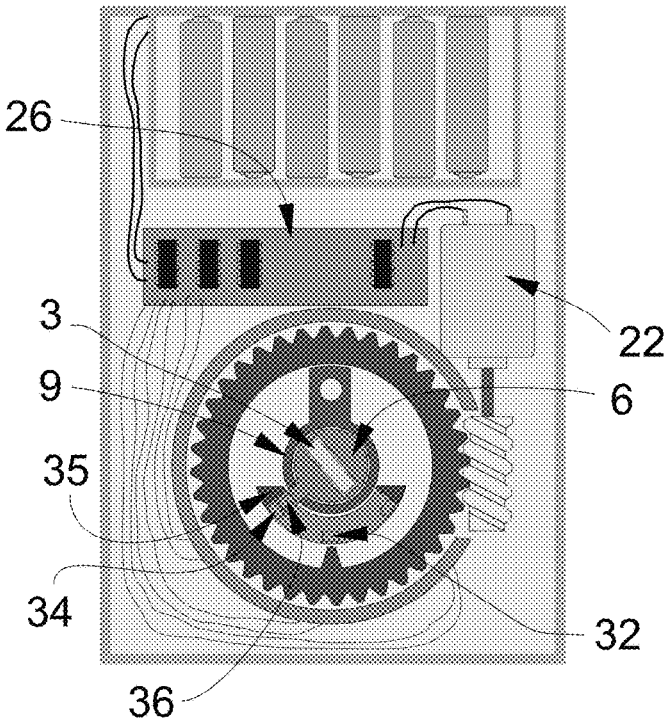
FIG. 16 is a schematic front view of elements of the embodiment of FIG. 14 in a rotated position.
Figure 17:
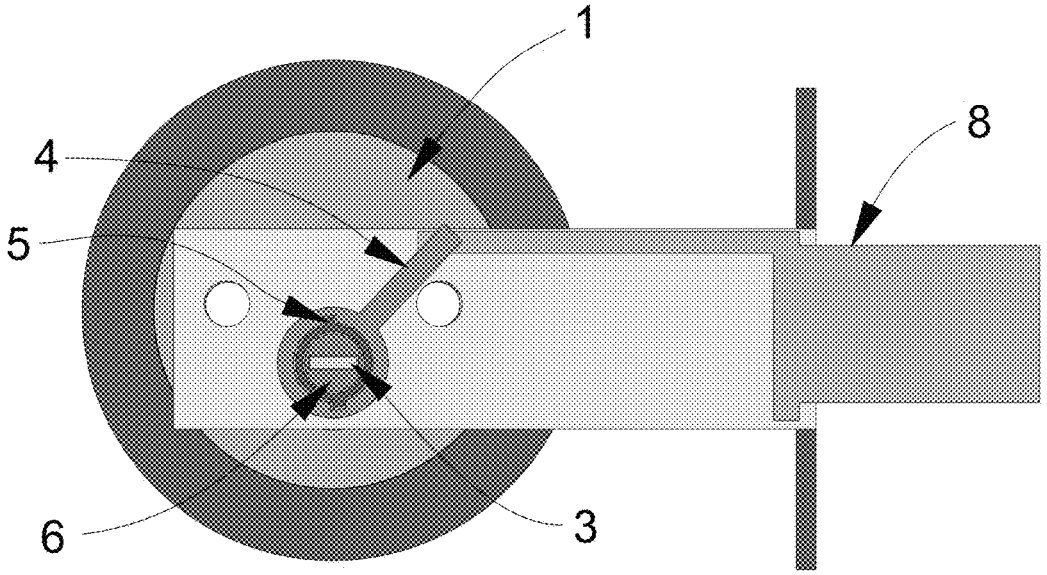
FIG. 17 is a schematic side view of lock elements generally corresponding to the illustrative embodiment of FIG. 14 with the bolt shown in the extended position.
Figure 18:
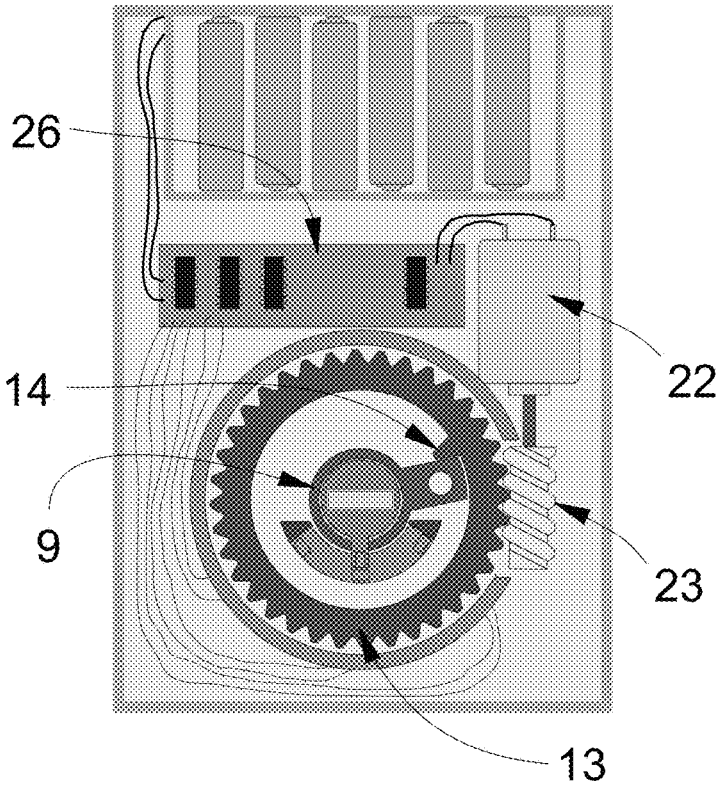
FIG. 18 is a schematic front view of lock elements of the embodiment of FIG. 14 with the elements shown in positions corresponding to the extended position of the bolt.

As illustratively shown in FIG. 14, another embodiment of the lock system 100 may be configured so that rotation of the plug by a properly-bitted key does not directly actuate and move the bolt 8 mechanically, but rather relies upon an electrical or electronic interface to cause bolt movement. More specifically, the tailpiece 3 of the plug causes rotation of the inner hub 6 as well as the hub tab 10. A pair of mechanical stops 35 limit the movement of hub tab 10 and thereby the rotation of the inner hub 6 to a predefined range. A magnet 36 or other interactive element may be positioned on the hub tab 10 to electrically or magnetically interact with a plurality of sensors 32, 33, and 34, which are connected by wires 31 to the circuit board. Sensors 32, 33, and 34 detect the relative position of the hub tab 10 and therefore the orientation of the plug 2 and the shell 1 of the lock. The sensor 32 may detect positioning of the hub tab in a central or neutral position, while the sensor 33 may detect rotation of the hub tab in a first rotational direction and the sensor 34 may detect rotation of the hub tab in an opposite rotational direction. The illustrative drawing of FIG. 16 shows the plug tailpiece and the inner hub being rotated in a locked direction. FIG. 15 shows rotation of the tailpiece 3 and the inner hub 6 without rotating outer hub 5 or movement of the lever 4. Returning to FIG. 16, the sensor 34 may detect the proximity of the magnet 36 on the hub tab and communicate the relative rotation of the plug to the circuitry. The logic of the circuitry may then determine whether the operating motor 22 should be turned on to rotate the operating worm gear 23 to cause the gear 13 to rotate and cause the contact point 14 on the gear 13 to engage the cam 9 extension of the outer hub to rotate the outer hub (see FIG. 18) and thereby cause movement of the lever 4 and extension of the bolt 8 as shown in FIG. 17. The determination made by the circuitry may depend upon the mode in which the lock system is operating. If the lock system is operating in the first mode, then the mere turning of the plug by the (presumably) correctly-bitted key, when detected by the appropriate sensor 33 or 34, will trigger the circuitry to operate the operating motor 22. In cases where the lock system is operating in the third mode, requiring not only mechanical actuation but also electronic credentials, the system 100 may detect whether the proper electronic credentials have been presented to the lock system in addition to the plug having been turned by the key. In the third mode, only if both of these conditions are met will the circuitry trigger the operating motor 22 to cause the bolt to be extended.

Figure 19:
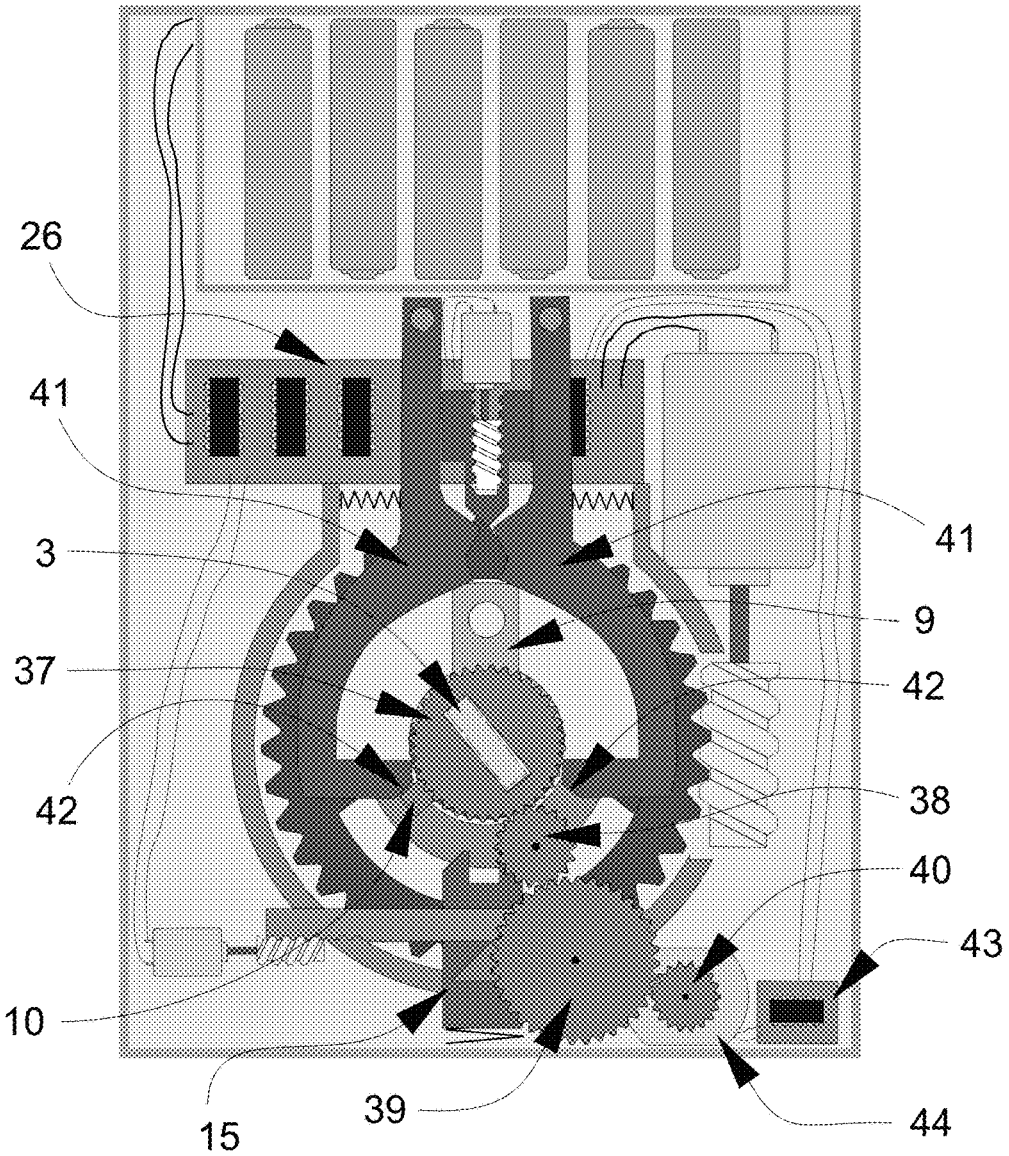
FIG. 19 is a schematic front view of another illustrative embodiment of the lock system with elements in a position at least partially blocking the rotation of the plug.

As illustratively illustrated in FIG. 19, a gear 37 may be connected to the inner hub 6, and interface gears 38 and 39 may be provided to transfer rotational motion of the gear 37 to a gear 40 that is attached to a charging generator 44 that generates electrical power which is transmitted to a charging circuit 43. This configuration may provide the ability to provide a degree of charging to the batteries from a battery dead condition in order to provide some degree of functionality of the electrical components of the lock system (particularly in embodiments where there is not a mechanical override provided).

Figure 20:
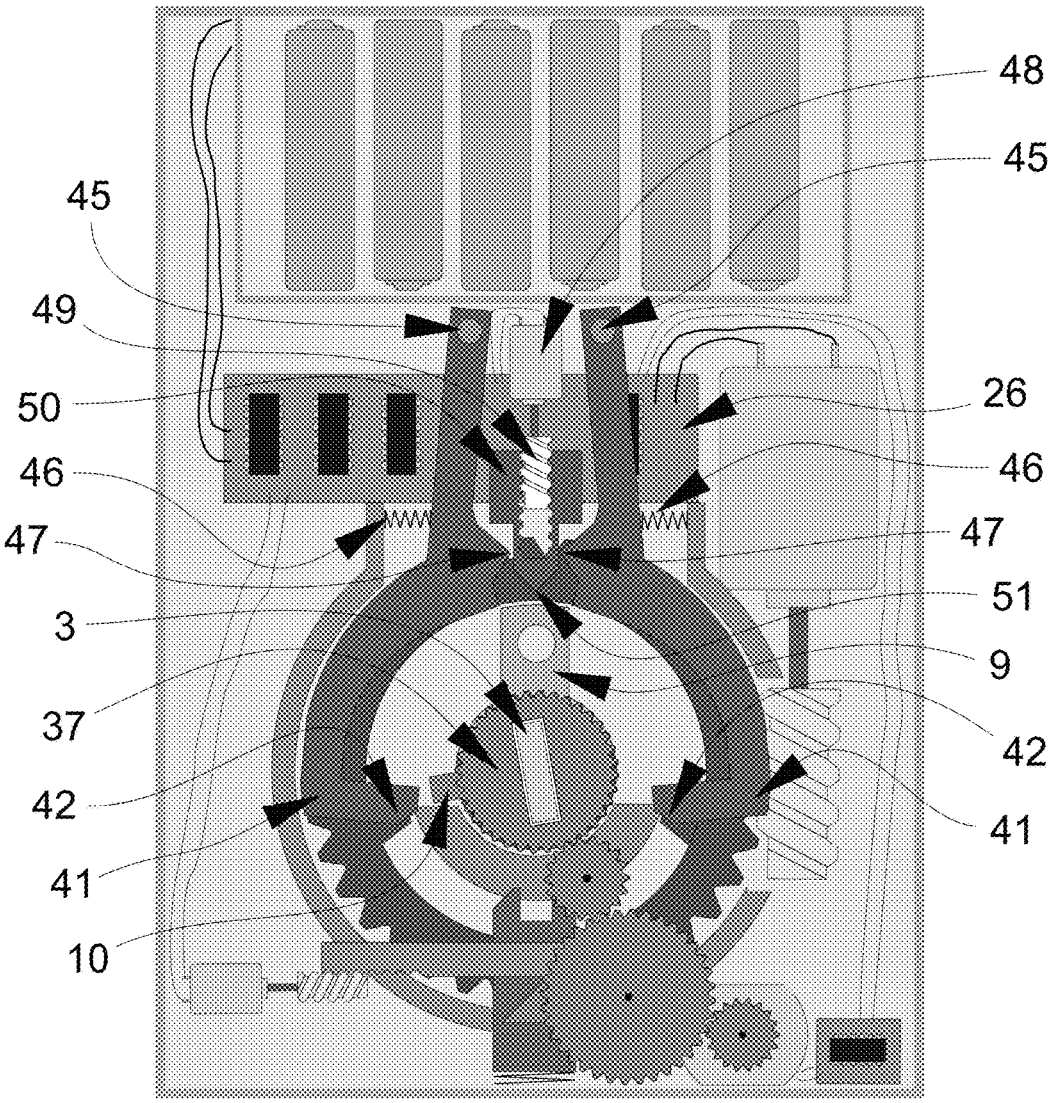
FIG. 20 is a schematic front view of the illustrative embodiment of FIG. 19 with elements in a position not blocking the rotation of the plug.
Figure 21:
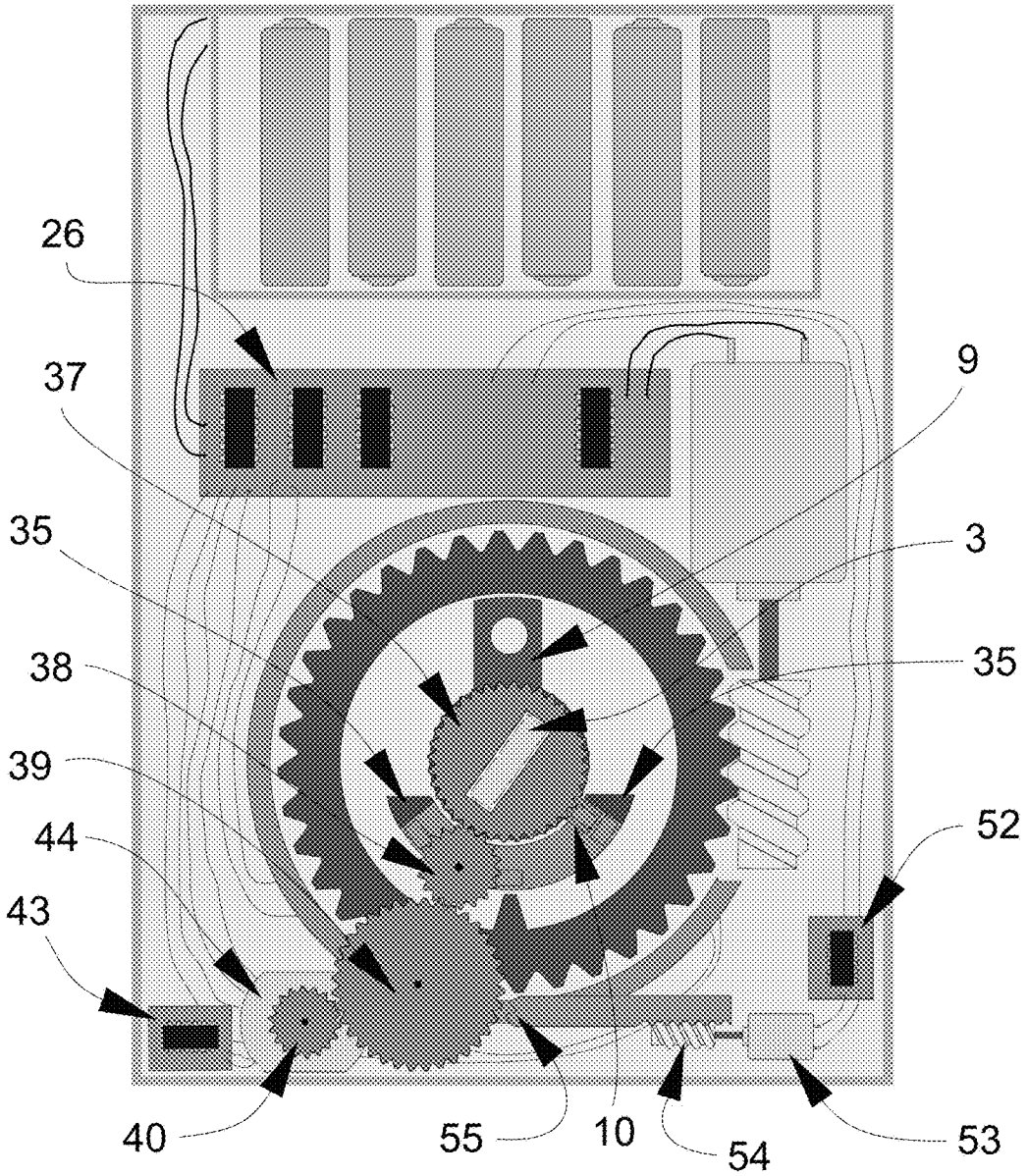
FIG. 21 is a schematic front view of another illustrative embodiment of the lock system.

As also shown in FIG. 19, a structure may be provided for selectively limiting the range of movement of the hub tab 10 and thereby the movement of the plug tailpiece 3. A pair of arms 41 may be pivotally mounted on pivot pins 45 and provided with contact points 42 which, when the arms 41 are located in the block position (as shown in FIG. 19), serve to block rotational movement of the hub tab 10 beyond a predetermined arc of movement. As shown in FIG. 20, the arms 41 may be moved into an unblocked position by the operation of a motor 48 that rotates a worm gear 49 to move a spreading element 50 with its tip 51 that contacts surfaces 47 of the arms 41 and pivots them relatively outward into an unblocked position against the bias of springs 46 which act on the arms in opposition to the movement of the spreading element 50 (as shown in FIG. 20).

Figure 22:
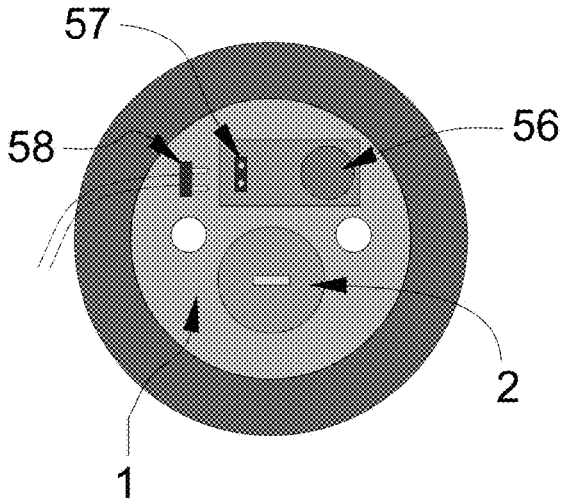
FIG. 22 is a schematic front view of lock elements of an illustrative embodiment of the lock system incorporating a sound detector, according to an illustrative embodiment.
Figure 23:
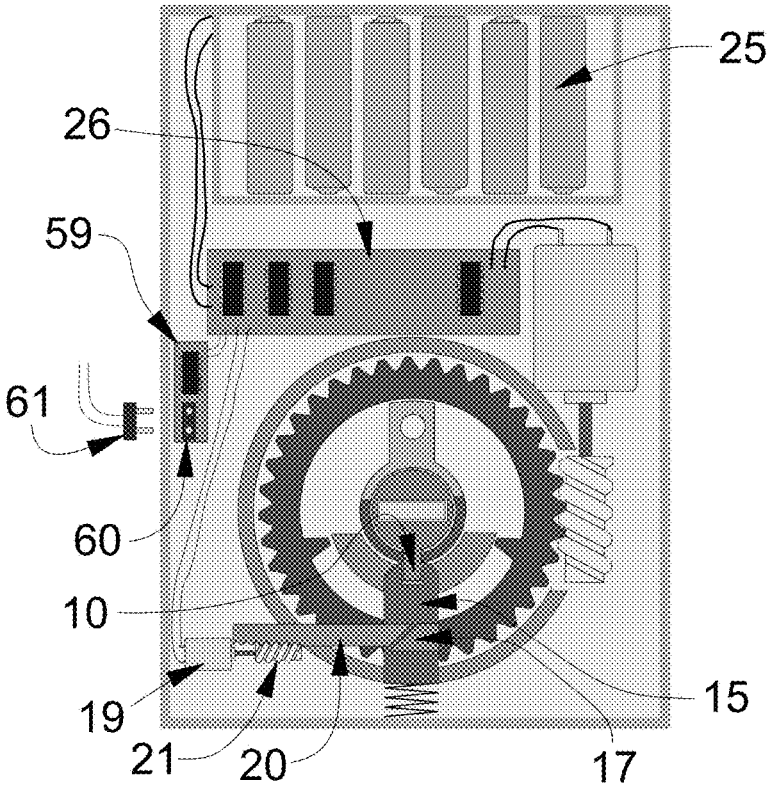
FIG. 23 is a schematic front view of an illustrative embodiment of the lock system utilizing a sound detector and a sound processor for detecting and identifying sounds associated with attempts to compromise the lock.

Looking to FIG. 22, an embodiment of the lock system is shown which includes a sound sensor or detector 56, which may suitably comprise a microphone, which is configured to detects sounds relating to the lock that are suggestive of an attempt to covertly or forcibly overcome the integrity of the lock. Such techniques for compromising a lock may include, for example, picking, rake picking, impressioning, and bumping, although the range of techniques are not limited to those listed here. Such techniques may have characteristics sounds associated with each one or with more than one, and may include, as an example, the sound of a pick device contacting the pin tumblers within the plug and cylinder, the insertion or impacting of a bump key inserted into the lock, etc. Such sounds may be one or more sound signatures can be developed for various methods of compromising the lock system and stored. The sound signatures may be developed for the particular lock or lock design, or generalized sound signatures may be developed for the techniques that apply to a variety of different lock designs. Recognizing that one of the methods of compromise is being attempted is typically more important than recognizing which type of compromise method is being attempted. Such sounds may need to be distinguished from sounds generated during legitimate use of the lock, such as insertion of the key into the lock cylinder and turning of the lock cylinder.

The characteristic sound signatures may be stored in the lock system, such as on a sound processor 59 which also has the ability to compare the signatures of sounds detected by the sound detector 56 and transmitted to the processor 59 (e.g., through connectors 57, 58, cable 60 and connectors 60, 61). In operation, a sound detected by the sound detector 56 may be compared to the stored sounds by the sound processor 59 to determine the possibility that the detected sound corresponds to one of the stored compromise signatures and that an attempt is being made to compromise the lock using one of the known (or even unknown) techniques. Such comparison may also include distinguishing the detected sound from the sound signature of a legitimate locking opening activity.

When a sound signature is detected that corresponds to, or is determined likely to correspond to, an action to compromise the lock, the lock system may be programed or otherwise configured to prevent operation of the lock and may be further configured to block the operation of lock elements that are necessary to open the lock (e.g., retract the bolt). Any suitable technique for disabling the lock elements, or blocking of operative movement of the lock elements, may be employed, and may include the various techniques disclosed in this disclosure. For example, the blocking element 15 may be moved to the blocking position to prevent lock actuation and bolt movement. Blocking the plug from turning (e.g., without relying upon the positions of the pin tumblers to block plug rotation) effectively blocks those methods of compromise that rely upon pin tumblers manipulation, such as bumping, picking, or using other tools used to manipulate the pins. This condition in which the lock cannot be operated using the physical key may be cancelled in various suitable manners, including the presentation of an authorized electronic credential to the lock system, which upon recognition removes the inoperable status of the lock.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A lock system comprising a lock assembly including a locking element movable between a locking position and an unlocking position;

a first lock actuating assembly configured to be mechanically operated to actuate the locking element of the lock assembly to move between the locking and unlocking positions;

a second lock actuating assembly configured to be electrically operated to actuate the locking element of the lock assembly to move between the locking and unlocking positions;

wherein the lock assembly and the first and second lock actuating assemblies have a plurality of user-selectable operating modes, the plurality of modes comprising:

a first mode of operation in which, when selected by the user, only the first lock actuating assembly is capable of actuating the lock assembly;

a second mode of operation in which, when selected by the user, only the second lock actuating assembly is capable of actuating the locking element of the lock assembly; and a third mode of operation in which, when selected by the user, the lock assembly is actuated only by operation of the first lock actuating assembly in combination and substantially simultaneously with operation of the second lock actuating assembly.

2. The system of claim 1 wherein the first mode of operation is further characterized by the second lock actuating assembly being incapable of actuating the lock assembly.

3. The system of claim 2 wherein the second mode of operation is further characterized by the first lock actuating assembly being incapable of actuating the lock assembly.

4. The system of claim 1 wherein the first lock actuating assembly is configured to actuate the lock assembly independently of the second lock actuating assembly in at least one mode of operation and the second lock actuating assembly is configured to actuate the lock assembly independently of the first lock actuating assembly in at least one mode of operation.

5. The system of claim 1 wherein mechanical operation of the first lock actuation assembly occurs through a physical object.

6. The system of claim 5 wherein the physical object comprises a key.

7. The system of claim 1 wherein the first lock actuating assembly includes a plug with a key slot configured to receive a key such that a key is capable of rotating the plug and a tailpiece extending from the plug to actuate the lock assembly.

8. The system of claim 1 wherein electrical operation of the second lock actuating assembly occurs through reception of a wireless signal by the second lock actuating assembly.

9. The system of claim 1 wherein the locking element comprises a bolt movable between a retracted position corresponding to the unlocking position and an extended position corresponding to the locking position.

10. The system of claim 9 wherein the bolt of the locking element is configured to extend from a door in the locking position and retract into a door in the unlocking position.

11. A lock system comprising a lock assembly including a locking element movable between a locking position and an unlocking position;

a first lock actuating assembly configured to be mechanically operated to actuate the locking element of the lock assembly to move between the locking and unlocking positions, mechanical operation of the first lock actuation assembly occurring through a physical object;

a second lock actuating assembly configured to be electrically operated to actuate the locking element of the lock assembly to move between the locking and unlocking positions, electrical operation of the second lock actuating assembly occurring through reception of a wireless signal by the second lock actuating assembly;

wherein the lock assembly and the first and second lock actuating assemblies have a plurality of user-selectable operating modes, the plurality of modes comprising:

a first mode of operation in which, when selected by the user, only the first lock actuating assembly is capable of actuating the lock assembly and the second lock actuating assembly being incapable of actuating the lock assembly;

a second mode of operation in which, when selected by the user, only the second lock actuating assembly is capable of actuating the locking element of the lock assembly and the first lock actuating assembly being incapable of actuating the lock assembly; and a third mode of operation being in which, when selected by the user, the lock assembly is actuated only by operation of the first lock actuating assembly in combination and substantially simultaneously with operation of the second lock actuating assembly.

12. The system of claim 11 wherein the first lock actuating assembly is configured to actuate the lock assembly independently of the second lock actuating assembly in at least one mode of operation and the second lock actuating assembly is configured to actuate the lock assembly independently of the first lock actuating assembly in at least one mode of operation.

13. The system of claim 11 wherein the physical object comprises a key.

14. The system of claim 11 wherein the first lock actuating assembly includes a plug with a key slot configured to receive a key such that a key is capable of rotating the plug and a tailpiece extending from the plug to actuate the lock assembly.

15. The system of claim 11 wherein the locking element comprises a bolt movable between a retracted position corresponding to the unlocking position and an extended position corresponding to the locking position.

16. A lock system comprising a lock assembly including a locking element movable between a locking position and an unlocking position;

a first lock actuating assembly configured to be mechanically operated to actuate the locking element of the lock assembly to move between the locking and unlocking positions, mechanical operation of the first lock actuation assembly occurring through a physical object;

a second lock actuating assembly configured to be electrically operated to actuate the locking element of the lock assembly to move between the locking and unlocking positions, electrical operation of the second lock actuating assembly occurring through reception of a wireless signal by the second lock actuating assembly;

wherein the lock assembly and the first and second lock actuating assemblies have at least one user-selectable mode of operation characterized by the lock assembly being actuated only by operation of the first lock actuating assembly in combination and substantially simultaneously with operation of the second lock actuating assembly.

17. The system of claim 1 wherein a said mode of operation is set through wireless communication with the system.

18. The system of claim 1 wherein in the first mode of operation, the second lock actuating assembly is prevented from actuating the locking element of the lock assembly.

19. The system of claim 18 wherein in the second mode of operation, the first lock actuating assembly is prevented from actuating the locking element of the lock assembly.

20. The system of claim 19 wherein in the third mode of operation, actuation of the lock assembly by the first lock actuating assembly alone is prevented and actuation of the lock assembly by the second lock actuating assembly alone is prevented.

21. The system of claim 1 wherein in the first mode of operation, the second lock actuating assembly is disengaged from actuating the locking element of the lock assembly.

22. The system of claim 21 wherein in the second mode of operation, the first lock actuating assembly is disengaged from actuating the locking element of the lock assembly.

* * * * *